US006411174B1

(12) United States Patent
Crouch et al.

(10) Patent No.: US 6,411,174 B1
(45) Date of Patent: Jun. 25, 2002

(54) COMPACT FOUR-WAY WAVEGUIDE POWER DIVIDER

(75) Inventors: David D. Crouch, Corona; Vincent Giancola, Chino; Kenneth W. Brown, Yucaipa, all of CA (US)

(73) Assignee: Raytheon Company, Lexington, MA (US)

( * ) Notice: Subject to any disclaimer, the term of this patent is extended or adjusted under 35 U.S.C. 154(b) by 27 days.

(21) Appl. No.: 09/593,201

(22) Filed: Jun. 14, 2000

(51) Int. Cl.[7] ..... H01P 5/12
(52) U.S. Cl. ..... 333/125; 333/137
(58) Field of Search ..... 333/125, 137, 333/336

*Primary Examiner*—Justin P. Bettendorf
*Assistant Examiner*—Joseph Chang
(74) *Attorney, Agent, or Firm*—William J. Benman; Colin M. Raufer; Glenn H. Lenzen, Jr.

(57) ABSTRACT

A compact four-way waveguide power divider (10). The inventive power divider (10) includes an input waveguide (11) that terminates at a junction with two adjacent waveguides on opposite sides of the input waveguide. On the opposite side of the junction is a conducting wall into which is built an inductive septum (20). The inductive septum (20) serves to partially match the input impedance of the structure. Second and third inductive septums (22 and 24) are also built into the output arms of the power divider (10). The purpose of the second and third septums (22 and 24) is twofold. In addition to partially matching the power divider's input impedance, the positions of the second and third septums (22 and 24) can be adjusted to equalize the power division between the output arms. Hence, the waves exiting the four output arms of the power divider have highly equalized amplitudes and phases. Further, the phases at the output ports are equalized by adjusting the lengths of the output arms. The use of offset inductive septums (22 and 24) in the output arms to achieve equalized power division allows the input and output waveguides to be placed in very close proximity, resulting in an extremely compact structure.

27 Claims, 5 Drawing Sheets

FIG. 4C
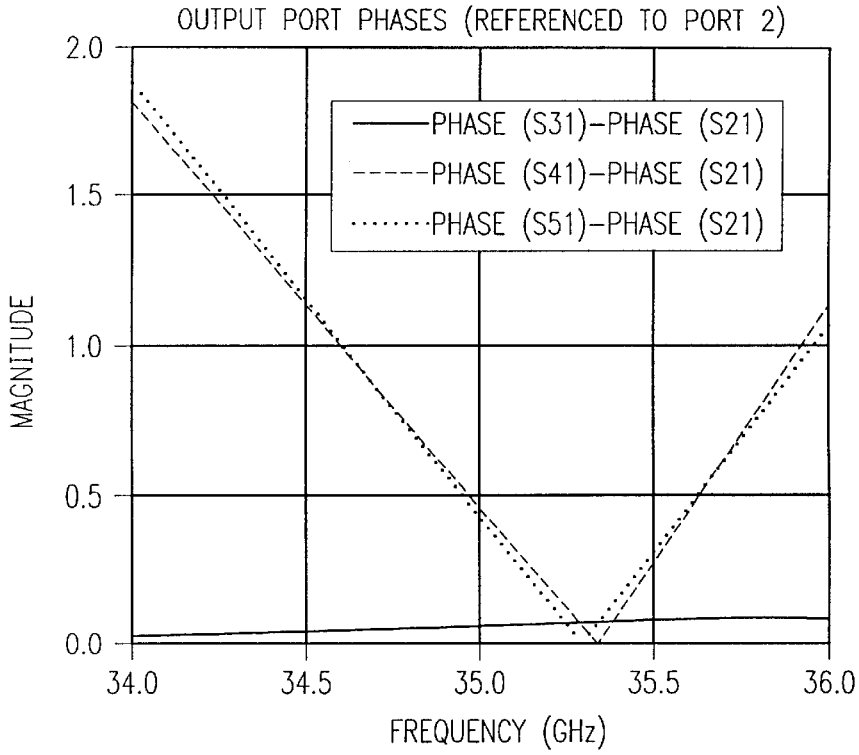
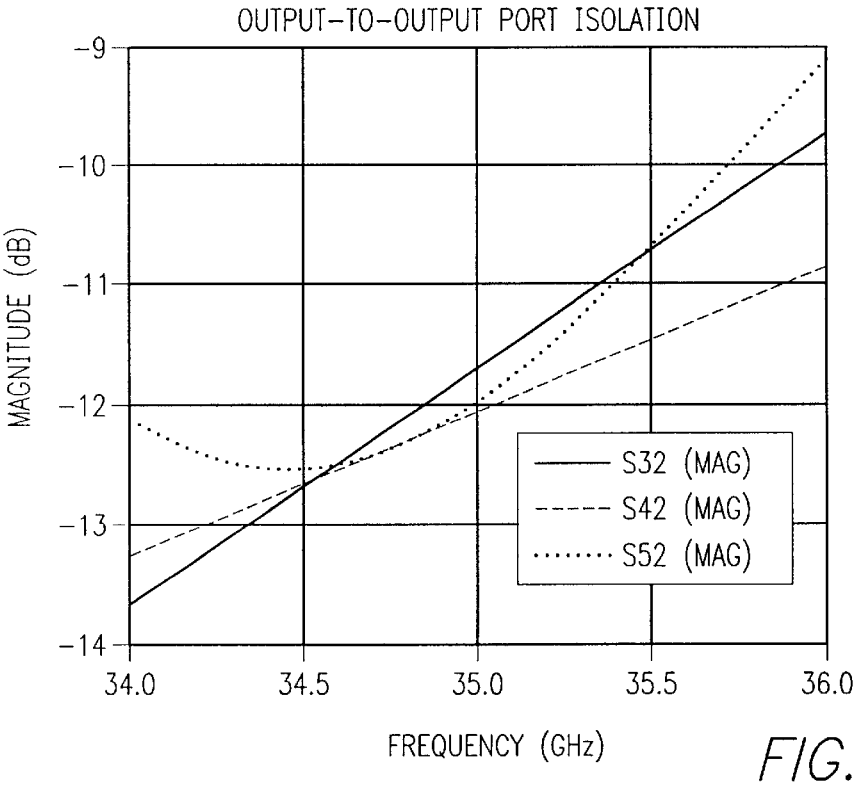
FIG. 4D

COMPACT FOUR-WAY WAVEGUIDE POWER DIVIDER

This invention was at least partially developed under contract N66857-98-C1613 with U.S. Navy. Accordingly, the U.S. Government may have certain rights in this invention.

BACKGROUND OF THE INVENTION

1. Field of the Invention

The present invention relates to high frequency electromagnetic circuits and systems. More specifically, the present invention relates to waveguide power dividers for use with radar systems.

2. Description of the Related Art

High frequency (e.g. microwave) circuits and systems typically require a division of power between two or more paths. Radar duplexers, for example, require an equal division of input power among the four output arms while simultaneously minimizing the phase difference between any two arms and the amount of reflected power. A duplexer is a device that splits microwave (radar) energy between two or more paths.

Conventional four-way power dividers that operate between 1 and 140 GHz are typically constructed from three two-way power dividers. Two-way power dividers automatically provide equal power division via symmetry and typically use a single inductive septum or post to match the input impedance.

To ensure equal division of power and high return losses in a four-way power divider constructed from three two-way power dividers, however, one must allow enough distance between adjacent two-way power dividers to allow evanescent waveguide modes to die out. The disadvantage of such structures is therefore size. Even if such a power divider is constructed as a single unit—rather than by connecting together three separate two-way dividers—it must be large to achieve equal power division and high return losses.

Hence, a need exists in the art for a compact four-way power divider for high frequency (microwave) applications.

SUMMARY OF THE INVENTION

The need in the art is addressed by the compact four-way waveguide power divider of the present invention. The inventive power divider includes an input waveguide that terminates at a junction with two adjacent waveguides on opposite sides of the input waveguide. On the opposite side of the junction is a conducting wall into which is built an inductive septum. The inductive septum serves to partially match the input impedance of the structure. Second and third inductive septums are also built into the output arms of the power divider. The purpose of the second and third septums is twofold. In addition to partially matching the power divider's input impedance, the positions of the second and third septums can be adjusted to equalize the power division between the output arms. Hence, the waves exiting the four output arms of the power divider have highly equalized amplitudes and phases. Further, the phases at the output ports are equalized by adjusting the lengths of the output arms.

A novel feature of the invention is the use of offset inductive septums in the output arms to achieve equalized power division. This allows the input and output waveguides to be placed in very close proximity, resulting in an extremely compact structure. The total width of the compact four-way power divider is the sum of the widths of the input and two output waveguides (each output waveguide containing two output arms) plus the thickness of the waveguide walls.

BRIEF DESCRIPTION OF THE DRAWINGS

FIG. 4*c* is a graph showing calculated output port phases (taking the phase at Port 2 as a reference) of the illustrative implementation of a power divider constructed in accordance with the present teachings.

FIG. 4*d* is a graph showing the calculated port-to-port isolation of the illustrative implementation of a power divider constructed in accordance with the present teachings.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications. applications, and embodiments within the scope thereof and additional fields in which the present invention would be of significant utility.

The present invention is a compact four-way waveguide power divider whose outputs have nearly equal amplitudes and phases. A realization of this invention at 35 GHz is shown in FIG. 1.

Figure 1:
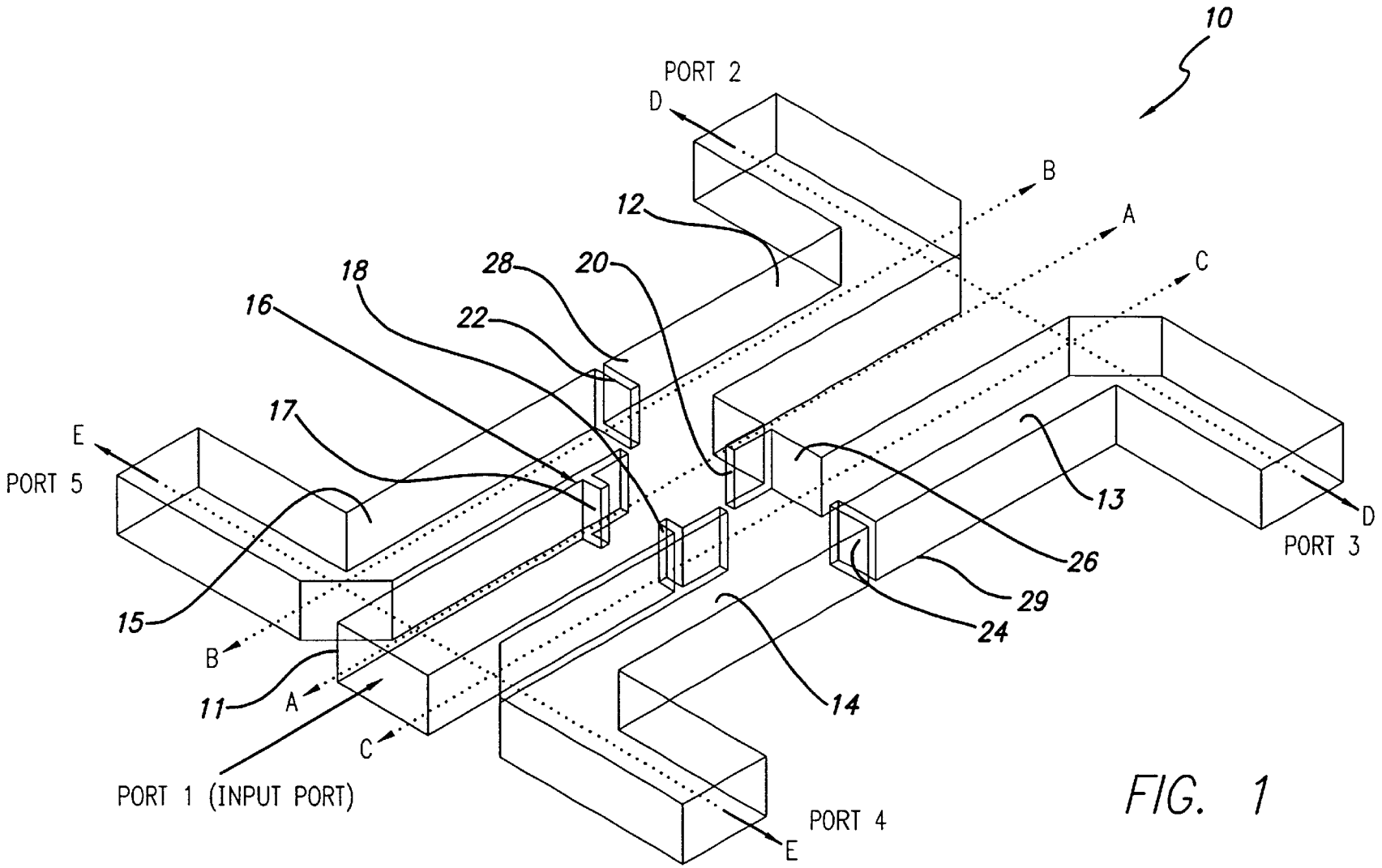
FIG. 1 is an isometric view of a compact four-way waveguide power divider constructed in accordance with the teachings of the present invention.

FIG. 1 is an isometric view of a compact four-way waveguide power divider constructed in accordance with the teachings of the present invention. The power divider 10 includes a first elongate rectangular waveguide 11 which serves as an input port. Second, third, fourth and fifth elongate rectangular waveguides 12, 13, 14 and provide first, second, third and fourth output ports, respectively. The input port has a longitudinal axis a-a; the second and fifth ports share a longitudinal axis b-b; and the third and fourth ports share a longitudinal axis c-c. Each Output port has a 90° bend to distribute power away from the input port (Port 1). Thus, Ports 2 and 3 have bends aligned with the transverse axis d-d and Ports 4 and 5 have bends aligned with the transverse axis e-e.

In the illustrative embodiment, the power divider 10 is implemented in WR-28 waveguide, which is constructed by machining the waveguide channels in a block of aluminum.

A conventional inductive matching iris 16 consisting of first and second elements 17 and 18, respectively, are disposed in the input port (11) near the distal end thereof. The elements 17 and 18 are mounted opposite from each other and extend into the waveguide cavity. The elements are mounted vertically in the input port transverse to the longitudinal axis a-a. The elements 17 and 18 are an integral part of the structure, and are machined from the aluminum block during fabrication. The dimensions of elements 17 and 18 are chosen to match the impedance of the input waveguide to the input impedance of the power divider and provide a minimum return loss (e.g., at least 22 dB) over an operating band (e.g., 34.5 to 35.5 GHz). The use of inductive irises for impedance matching is well known in the art.

In accordance with the present teachings, the divider 10 has first, second and third sidewall inductive septums 20, 22 and 24, respectively, that partially match the impedance of the power divider to that of the input waveguide and equalize the power division between the output arms. The use of septums for impedance matching is well known in the art; a single septum is commonly used as the impedance-matching element in two-way power dividers. The first septum 20 is mounted at a conductive rear wall 26 of the divider 10, parallel to the longitudinal axis a-a of the input port, and serves to partially match the impedance of the power divider to that of the input waveguide. The second septum 22 is mounted in alignment with the first septum 20, transverse to the longitudinal axis b-b, at a sidewall 28 subtending ports 2 and 5 of the divider 10. The third septum 24 is mounted in alignment with the first septum 20, transverse to the longitudinal axis c-c, at a sidewall 29 subtending ports 3 and 4 of the divider 10.

Power enters the four-way power divider 10 through the input port (Port I in FIG. 1). The inductive iris 16 in the input waveguide, in concert with the inductive septums 20, 22 and 24 serve to match the input impedance of the four-way power divider, minimizing the amount of reflected power. The position of the sidewall septums 22 and 24 is adjusted to equalize the power distribution. For example, by adjusting the position of the inductive septum 24 the power exiting Ports 3 and 4 can be equalized. Since the divider 10 is symmetric about the axis a-a of the input waveguide, the ideal locations for the sidewall inductive septums on the right- and left-hand sides of the power divider are identical. This symmetry also ensures that the phase at Port 2 is equal to that at Port 3 and the phase at Port 4 is equal to that at Port 5. The phases at all ports are equalized by adjusting the lengths of the waveguide arms leading to Ports 2 and 3 with respect to those leading to Ports 4 and 5.

Figure 2:
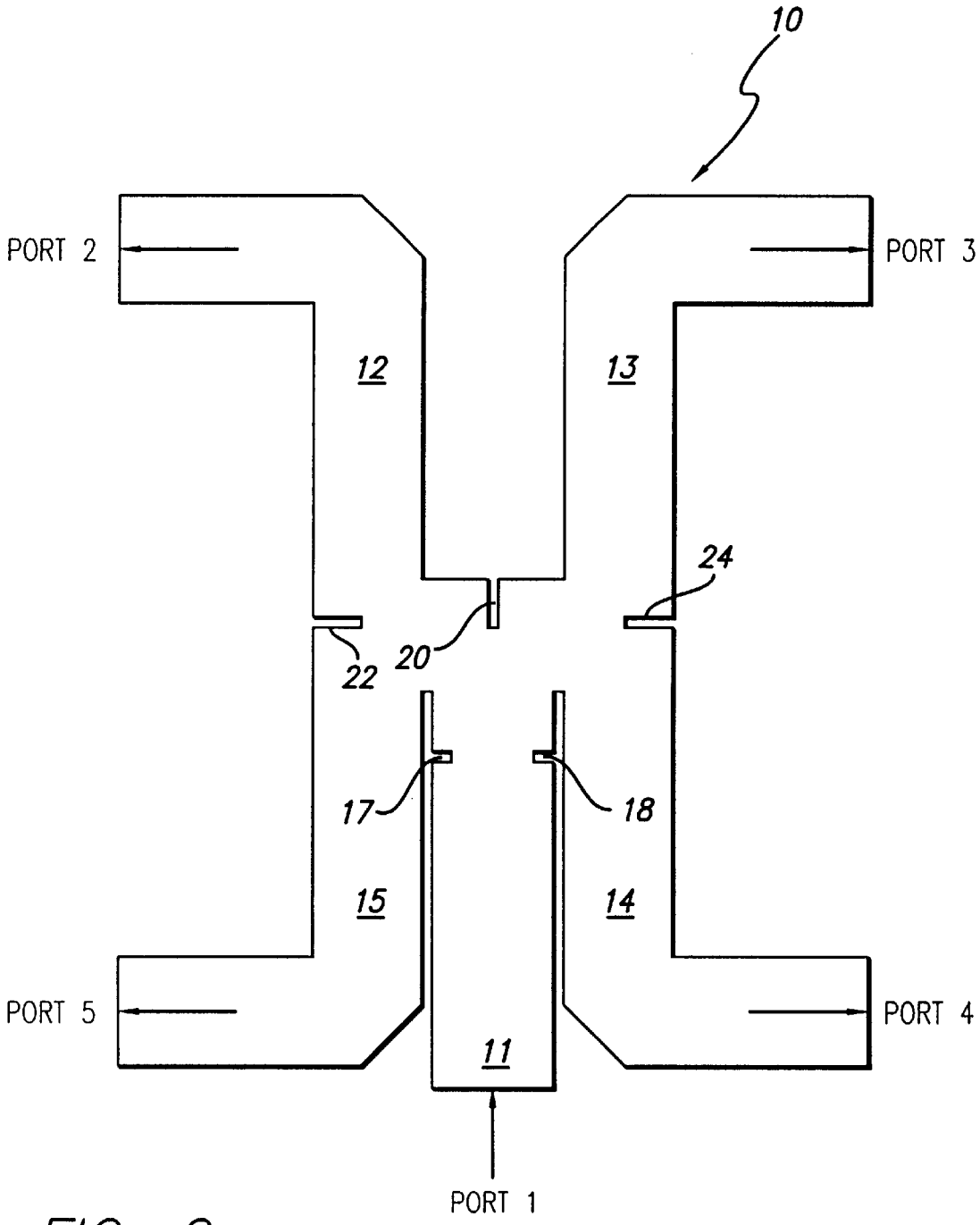
FIG. 2 is an illustrative physical layout of the divider of FIG. 1 with advantageous dimensional ratios shown.

FIG. 2 is an illustrative physical layout of the divider of FIG. 1 with advantageous dimensional ratios shown. In the illustrative embodiment, the divider 10 has an interior width of 0.28" and an interior height of 0.14", and is designed for use at 35 GHz. The total width of the illustrative power divider 10 is 0.96", which includes the interior widths of the three waveguides and also four walls each of width 0.03". Those skilled in the art will appreciate that the present teachings are not limited to the shape and size of the illustrative divider of FIG. 1. For example, the illustrative power divider shown in FIGS. 1 and 2 can be implemented in half-height WR-28 waveguide, i.e., waveguide having an interior width of 0.28" and an interior height of 0.07", with no change in performance. In practice, each waveguide would be designed, shaped and dimensioned to facilitate communication of electro-magnetic energy at the modes and frequencies required for a given application.

The inductive septums 20, 22 and 24 provide a partial impedance match. A matching network in the input waveguide may be used to provide an improved impedance match. Depending on the bandwidth requirement, a single inductive iris 16 such as that shown in FIGS. 1 and 2 can be used to match the impedance in accordance with conventional teachings.

Figure 3:
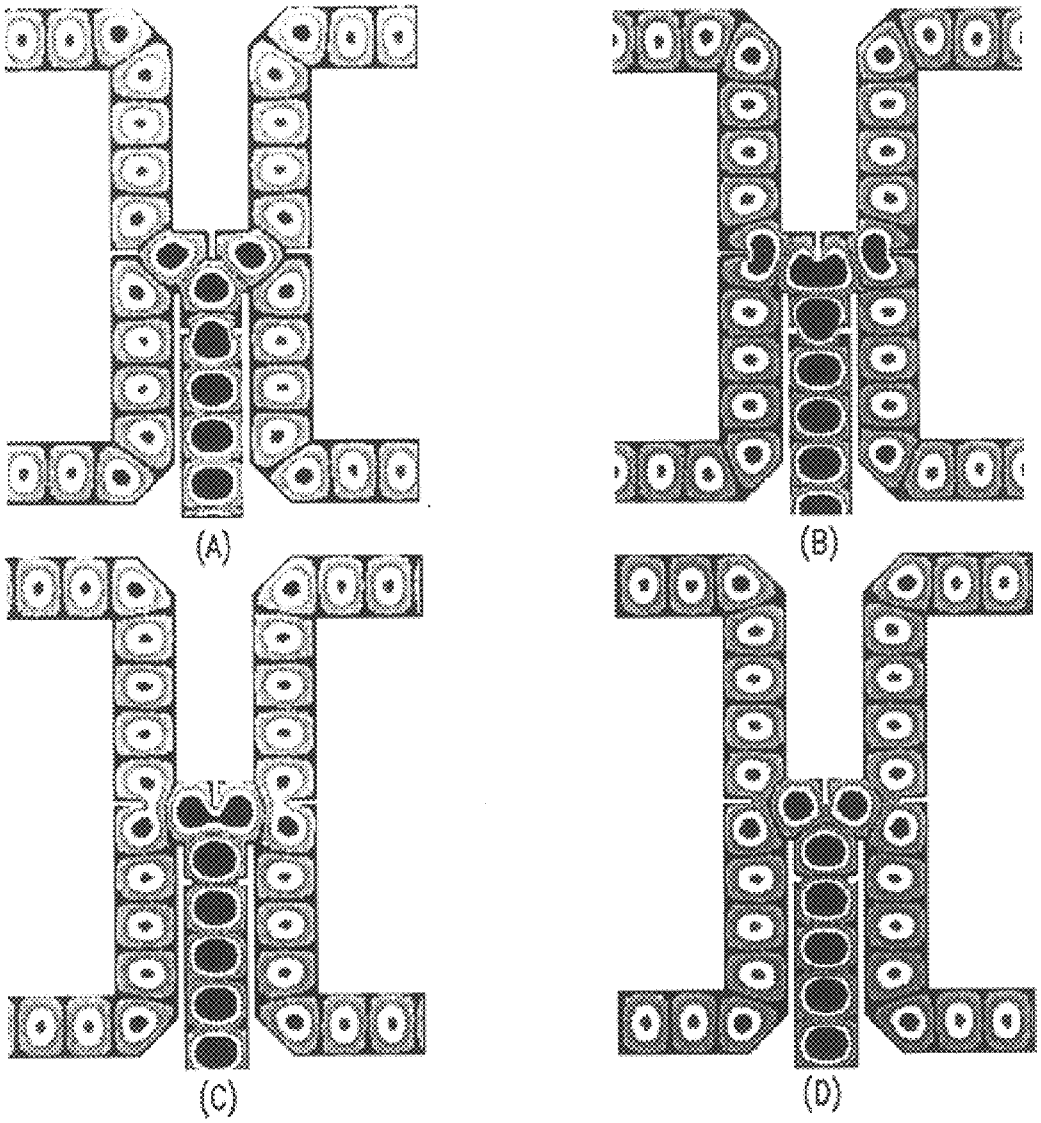
FIG. 3 is a sequence of computer-generated frames showing the evolution of the electric-field magnitude in the compact four-way waveguide power divider.

The operation of the power divider 10 is illustrated in FIG. 3. FIG. 3 is a sequence of computer-generated frames showing the evolution of the electric-field magnitude in the compact four-way waveguide power divider 10. In FIG. 3(*a*), microwave power enters the device through Port 1 and a set of wavefronts approaches the inductive septums. The power is equally divided between the output arms by the first inductive septum 20 built into the conductive wall 26 at the end of the input waveguide 11. The septum 20 acts like a knife and nearly "slices" the wavefronts into two parts, each containing nearly equal amounts of power. The resulting wavefronts then impinge on the inductive septums 22 and 24 at the junctions of the output waveguides, where they are again sliced in two before proceeding to the output ports.

This is shown in FIGS. 3(*b*) and 3(*c*). In FIG. 3(*d*), the now completely divided wavefronts propagate away from the septums.

Referring again to FIG. 2, notice that the last set of septums 22 and 24 are offset from the center of the junction gap A. This is necessary to achieve equal power division. Also notice that the phases at all four output ports appear to be nearly equal as evidenced by the fact that the same point in the RF cycle is present at each output port. This is due to the fact that the lengths of the waveguides 12 and 13 leading to Ports 2 and 3, respectively, are longer than the waveguides 14 and 15 leading to Ports 4 and 5, respectively. It the arms were of equal length, the phases of the outputs at Ports 2 and 3 would lead those at Ports 4 and 5. Increasing the lengths of arms 2 and 3 relative to those of arms 4 and 5 equalizes the phases, as discussed below.

Figure 4A:
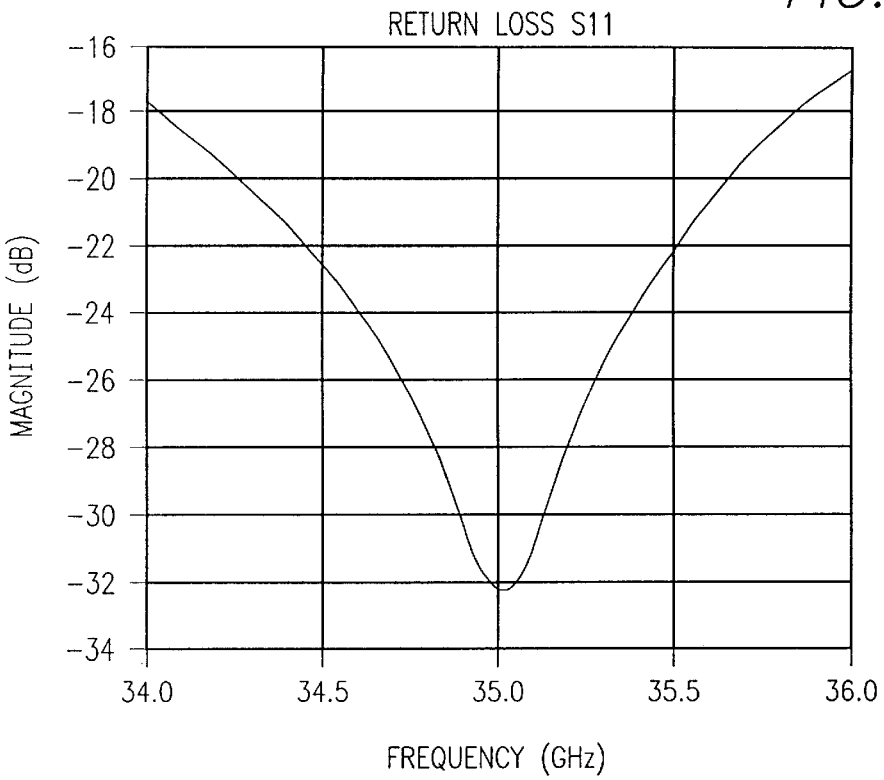
FIG. 4*a* is a graph showing the calculated return loss of the illustrative implementation of a power divider constructed in accordance with the present teachings.

The performance of the illustrative embodiment of a power divider constructed in accordance with the present teachings is summarized in FIGS. 4*a–d*. FIG. 4*a* shows the calculated return loss. In FIG. 4*a*, it is evident that the maximum return loss occurs very close to 35 GHz and the minimum return loss across the operating band (34.5 to 35.5 GHz) exceeds 22 dB. That is, the return loss exceeds 20 dB over a band extending from 34.3 GHz to 35.68 GHz, corresponding to a bandwidth of 3.9%.

Figure 4B:
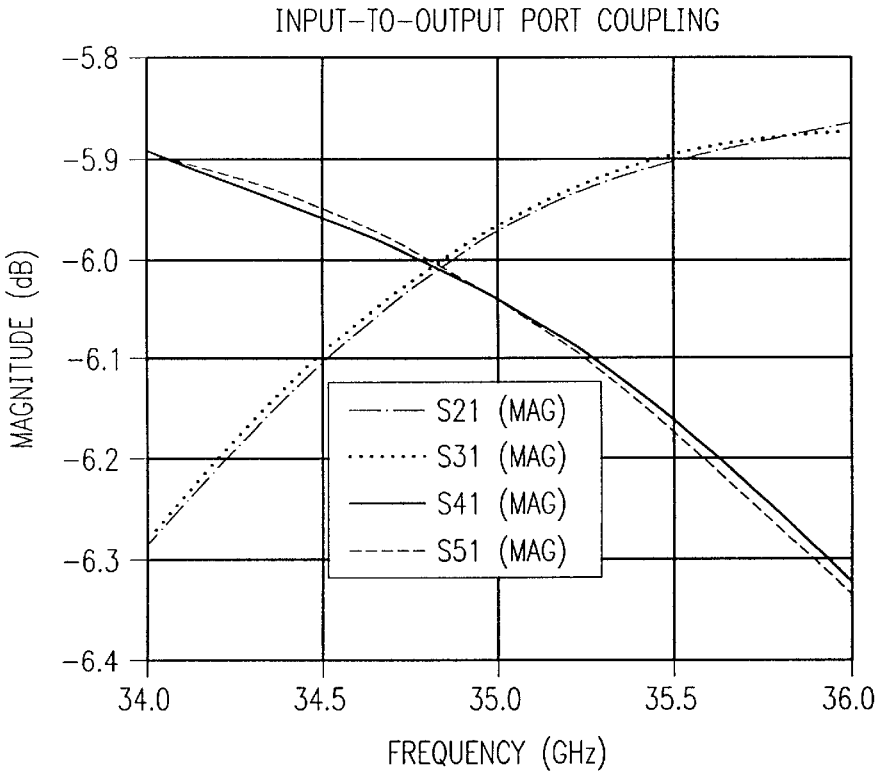
FIG. 4*b* is a graph showing the calculated coupling from the input to output Ports 2, 3, 4, and 5 of the illustrative implementation of a power divider constructed in accordance with the present teachings.

FIG. 4*b* shows the calculated coupling from the input to output Ports 2, 3, 4, and 5. The maximum difference in the coupling to different output ports within the operating band occurs between Ports 2 and 4 and is approximately 0.25 dB at 35.5 GHz. An ideal power divider would have a coupling of 6 dB to each arm (corresponding to ¼ of the input power) independent of frequency. Because the device is symmetric, the coupling to output Ports 2 and 4 will be nearly identical to the coupling to Ports 5 and 3, respectively. There will, of course, be slight variations due to manufacturing tolerances. As is evident from FIG. 4*b*, the worst-case coupling within the operating band (34.5–35.5 GHz) is approximately 6.17 dB.

In many applications (monopulse radar, for example), it is important that the phases at the four output ports of the power divider be highly equalized. As discussed earlier, this is achieved by adjusting the lengths of the arms leading to the output ports. The calculated output port phases (taking the phase at Port 2 as a reference) are shown in FIG. 4*c*, which shows that the phases are indeed nearly equal. The maximum phase difference between any two output ports over the operating band is only 1.12 degrees, which corresponds to a path length difference of only 0.0013" at 35 GHz.

Calculated port-to-port isolation is shown in FIG. 4*d*. Many radars require a high degree of isolation-between ports for proper operation. In FIG. 4*d*, it is evident that the power divider alone provides more than 10 dB of isolation over the operating bandwidth (34.5 to 35.5 GHz), which is comparable to that obtained from conventional four-way power dividers. That is, the isolation between different output ports is shown in FIG. 4*d*, which reveals a minimum isolation exceeding 10.5 dB over the operating band.

As noted earlier, the division of power between the output ports is equalized by adjusting the positions of the sidewall inductive septums. If desired, however, their positions can also be adjusted to obtain an unequal power split. For example, consider the 35 GHz four-way power divider shown in FIGS. 1–3, and suppose that a coupling of 6.32 dB to Ports 2 and 3 and a coupling of 5.73 dB to Ports 4 and 5 is desired. This can be achieved simply by moving the sidewall inductive septums 0.01" closer to Ports 2 and 3. Without modifying the inductive matching iris, the return loss exceeds 38 dB. Moreover, the power delivered to each output port can be adjusted individually by moving the first inductive septum 20 off center. This results in an uneven power split between the two halves of the power divider, one leading to Ports 2 and 5 and the other leading to Ports 3 and 4. The desired power split between Ports 2 and 5 can then be obtained by appropriately adjusting the position of the sidewall inductive septum 22. The desired power split between Ports 3 and 4 can likewise be obtained by adjusting the position of the sidewall inductive septum 24. If, however, a highly uneven power split is desired it may be necessary to modify the inductive matching iris to obtain an acceptable impedance match. In addition, uneven phases at the output ports can be accommodated by adjusting the lengths of the waveguide leading to each output port.

In summary, the present invention is a compact four-way power divider that delivers power having the desired amplitude and phase to its four output ports. A dramatic reduction in size in comparison to conventional four-way power dividers is realized by using offset inductive septums in the output arms to achieve the required power division. This step eliminates the need to separate the input and output waveguides by a distance sufficient to allow evanescent waveguide modes to die out - as is necessary with conventional four-way power dividers - and allows the input and output waveguides to be placed in very close proximity, resulting in an extremely compact structure.

Thus, the present invention has been described herein with reference to a particular embodiment for a particular application. Those having ordinary skill in the to art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A compact four-way power divider comprising:

a unitary block of conductive material having:

an input waveguide in communication with an input port;

a first, second, third and fourth output waveguides in communication with first, second, third and fourth output ports respectively;

a first inductive septum disposed in communication within said input waveguide for dividing input energy received thereby into first and second paths, said first path feeding said first and said second output waveguides and said second path feeding said third and said fourth output waveguides;

a second inductive septum disposed between said first and said second waveguides to divide said energy in said first path into third and fourth paths for output via said first and said second ports respectively; and a third inductive septum disposed between said third and said fourth waveguides to divide said energy in said second path into fifth and sixth paths for output via said third and said fourth ports respectively.

2. The invention of claim 1 further including an iris disposed in said input waveguide.

3. The invention of claim 1 wherein the lengths of said first and said third waveguides are equal.

4. The invention of claim 3 wherein the lengths of said second and said fourth waveguides are equal.

5. The invention of claim 4 wherein the length of said first and third waveguides is greater than the length of said second and fourth waveguides to equalize the phases of energy exiting said output ports.

6. The invention of claim 1 wherein the second septum is positioned to distribute power equally between said first and second output ports.

7. The invention of claim 6 wherein said third septum is positioned to distribute power equally between said third and fourth output ports.

8. The invention of claim 7 wherein the second septum is positioned to distribute power unequally between said first and second output ports.

9. The invention of claim 8 wherein said third septum is positioned to distribute power unequally between said third and fourth output ports.

10. The invention of claim 1 wherein the first septum is positioned to distribute power unequally between said first and second paths.

11. The invention of claim 10 wherein said second septum is positioned to distribute power unequally between said first and second output ports.

12. The invention of claim 11 wherein said third septum is positioned to distribute power unequally between said third and fourth output ports.

13. The invention of claim 1 wherein the lengths of said first and said third waveguides are unequal.

14. The invention of claim 13 wherein the lengths of said second and said fourth waveguides are unequal.

15. A compact four-way power divider comprising:

a unitary block of conductive material having:

an input waveguide in communication with an input port, said input waveguide further including an iris disposed in said input waveguide;

a first, second, third and fourth output waveguides in communication with first, second, third and fourth output ports respectively, the lengths of said first and third waveguides being greater than the lengths of said second and fourth waveguides to equalize the phases of energy exiting said output ports;

a first inductive septum disposed in communication with said input waveguide for dividing input energy received thereby into first and second paths, said first path feeding said first and said second output waveguides and said second path feeding said third and said fourth output waveguides;

a second inductive septum disposed between said first and said second waveguides to divide said energy in said first path into third and fourth paths for output via said first and said second ports respectively; and a third inductive septum disposed between said third and said fourth waveguides to divide said energy in said second path into fifth and sixth paths for output via said third and said fourth ports respectively.

16. The invention of claim 15 wherein the lengths of said first and said third waveguides are equal.

17. The invention of claim 16 wherein the lengths of said second and said fourth waveguides are equal.

18. The invention of claim 15 wherein the second septum is positioned to distribute power equally between said first and second output ports.

19. The invention of claim 18 wherein said third septum is positioned to distribute power equally between said third and fourth output ports.

20. The invention of claim 15 wherein the second septum is positioned to distribute power unequally between said first and second output ports.

21. The invention of claim 20 wherein said third septum is positioned to distribute power unequally between said third and fourth output ports.

22. The invention of claim 15 wherein the first septum is positioned to distribute power unequally between said first and second paths.

23. The invention of claim 22 wherein said second septum is positioned to distribute power unequally between said first and second output ports.

24. The invention of claim 23 wherein said third septum is positioned to distribute power unequally between said third and fourth output ports.

25. The invention of claim 15 wherein the lengths of said first and said third waveguides are unequal.

26. The invention of claim 25 wherein the lengths of said second and said fourth waveguides are unequal.

27. A method for achieving four-way power division including the steps of:

receiving energy via an input port in an input waveguide in a unitary block of conductive material;

a first, second, third and fourth output waveguides in communication with first, second, third and fourth output ports respectively;

dividing input energy received by said input port into first and second paths with a first inductive septum disposed in communication with said input waveguide, said first path feeding first and second output waveguides and second path feeding third and fourth output waveguides;

dividing energy in said first path into third and fourth paths, for output via said first and said second ports respectively, with a second inductive septum disposed between said first and said second waveguides; and dividing energy in said second path into fifth and sixth paths, for output via said third and said fourth ports respectively, with a third inductive septum disposed between said third and said fourth waveguides.

* * * * *